US006676256B2

(12) United States Patent
Yoshida et al.

(10) Patent No.: US 6,676,256 B2
(45) Date of Patent: Jan. 13, 2004

(54) PRINTER FOR WRAPPING MATERIAL

(75) Inventors: Kenzo Yoshida, Ikoma (JP); Hideo Matsuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/790,522

(22) Filed: Feb. 23, 2001

(65) Prior Publication Data

US 2001/0022594 A1 Sep. 20, 2001

(30) Foreign Application Priority Data

Feb. 23, 2000 (JP) ..... 2000-046366

(51) Int. Cl.[7] ..... B41J 3/407
(52) U.S. Cl. ..... 347/106
(58) Field of Search ..... 347/100, 406, 347/4, 2, 107; 229/87

(56) References Cited

U.S. PATENT DOCUMENTS 4,750,668 A * 6/1988 Behne et al. ..... 229/87

FOREIGN PATENT DOCUMENTS

| | | | |
|---|---|---|---|
| EP | 0705890 | A1 | 10/1996 |
| JP | 5149670 | A | 6/1993 |
| JP | 8113746 | A | 5/1996 |
| JP | 11170625 | A | 6/1999 |

* cited by examiner

*Primary Examiner*—Stephen D. Meier
*Assistant Examiner*—An H. Do
(74) *Attorney, Agent, or Firm*—Birch, Stewart, Kolasch & Birch, LLP

(57) ABSTRACT

Provided is a printer for a wrapping material making it possible to record time data such as the date and time when an article was wrapped on the surface of the wrapping material for wrapping the article. This printer includes a wrapping material storing section for storing a wrap film, which is a wrapping material for wrapping an article. There is a clock for measuring time to generate time data, and an output for recording the time data on the surface of the wrap film. When the wrap film is discharged from the wrapping material storing section, the output records the time data on the surface of the wrap film. Therefore, on the wrap film with which the article such as food is wrapped, the time data, for example, the date and time when this food was wrapped are recorded. Thus, a user can check accurately the date and time the wrapping occured.

31 Claims, 6 Drawing Sheets

PRINTER FOR WRAPPING MATERIAL

BACKGROUND OF THE INVENTION

1. Field of the Invention

The present invention relates to a printer for recording data on the surface of a wrapping material, and particularly to a printer for a wrapping material for recording, on a transparent wrap film used for wrapping foods or the like, time data such as the date and time when wrapping is carried out.

2. Description of the Related Art

Hitherto, in ordinary homes a refrigerator has been mainly used for storing foods. Particularly in recent years, a refrigerator has been made large-sized and its performance has been improved. Moreover, various functions have been given thereto. In general, food is wrapped with a wrap film superior in gas-barrier property and stored in a refrigerator to refrigeration-preserve or freezing-preserve the food. In combination with improvement in performance of refrigerators and enlargement in functions thereof, a large number of foods have been stored for a longer period.

However, when a large number of foods are stored in a refrigerator, it is difficult to memorize the preservation period of each of the foods. As a result, inconveniences as follows arise: the appreciation periods of some foods stored in the refrigerator have passed, or some foods have gone bad. Thus, in many cases, the foods have become uneatable.

Thus, in order to solve these problems, suggested are measures that a person records the date when a food is put into a refrigerator on the surface of a wrapping material, such as a wrap film, with which the person wraps the food, using a pen with an oil-based ink, or the like. In the measures, however, it is necessary that the person prepares the pen, checks the date on a calendar or the like, and manually records the date and so on one by one. There arise problems that these conducts may be troublesome for the person and cannot be repeatedly carried out. The odor of the oil-based ink in the pen transfers the food. This is unfavorable for food hygiene.

To solve the problems, for example, Japanese Unexamined Patent Publications JP-A 5-149670 (1993) and JP-A 11-170625 (1999) disclose the prior art wherein the date is printed onto a label and the label is attached onto a wrap film with which a food is wrapped. In the prior art disclosed in JP-A 5-149670, correct preservation date and time of a food are recognized by setting up a printing section in which date data and time data can be printed to a storing room for storing foods, making a label on which the date and time when a food is preserved and other data, and attaching this label onto the wrapping material or the container of the food. JP-A 11-170625 discloses a printer that can be afterward mounted on a refrigerator or the like. In a way similar to the above-mentioned prior art, it is possible to attach a label onto the wrapping material and check the preservation date and time thereof. Since the printer has a memory, it is also possible to make a database of stored foods.

However, in such prior art that a label is attached, there remains a problem that sufficient function cannot be exhibited unless a user consciously recognizes that a food is being preserved. That is, when a user preserves a food in the above-mentioned prior art, the following three steps are at least necessary: (1) the step of wrapping the food with a warp film to preserve the food; (2) the step of printing data such as the date on a label; and (3) the step of attaching the label on which the printing has been carried out onto the wrap film or the container for the food. Accordingly, in the case where the user stores a food in a refrigerator in the state that the user forgets that a label is attached onto the food, the steps (2) and (3) are not carried out at all. Thus, date-recognizing function is not sufficiently exhibited.

SUMMARY OF THE INVENTION

In light of the problems, a main object of the invention is to provide a printer for a wrapping material, capable of recording the preservation date and time of a food onto a wrapping material, such as a wrap film, to check the date when the food was stored in a refrigerator by the step (1) of wrapping an article, such as a food, with the wrapping material, the step (1) being a routine step, without undergoing the three steps (1)–(3) nor substantial self-awareness of a user.

Another object of the invention is to provide a printer for a wrapping material, capable of recording time data at a position which is highly visible for a user when an article is wrapped.

The invention provides a printer for a wrapping material comprising wrapping material storing means for storing a wrapping material for wrapping an article, clock means for measuring time to generate time data, and output means for recording the time data on a surface of the wrapping material, wherein when the wrapping material is discharged from the wrapping material storing means, the output means records the time data on the surface of the wrapping material.

According to the invention, time is measured by the clock means when the wrapping material is discharged from the wrapping material storing means. The generated time data is recorded on the surface of the wrapping material by the output means. Therefore, when a user wraps the article with the wrapping material, it is possible to remove such troublesome conducts as recording time data with a pen with an oil-based ink and attaching a label on which time data is recorded. Furthermore, even if the user forgets recording of any time data, time data such as the date and time when the article is wrapped are certainly recorded on the wrapping material. Thus, the user does not know the date and time when the article was wrapped.

In the invention, it is preferable that the wrapping material is wound around a tubular core, and the wrapping material storing means is provided with a supporting shaft for supporting the wrapping material wound around the core axially and rotatably, and a cutting blade section for cutting the wrapping material discharged from the wrapping material storing means by rotation of the core.

According to the invention, in the state that the wrapping material is wound around the tubular core the wrapping material is axially and rotatably supported by the supporting shaft in the wrapping material storing means. When the article is wrapped, a user rotates the core and pulls out the wrapping material having a necessary length to cut the wrapping material with the cutting blade section. Therefore, the user uses only the wrapping material having the necessary length so that the user can wrap the article.

In the invention, it is preferable that a power source section is stored in the core for winding the wrapping material.

According to the invention, a space can be saved by the volume of the power source section and the whole of the present apparatus can be made small since the power source section is stored in the core for winding the wrapping material.

In the invention, it is preferable that the output means is ink-jet recording means for jetting an ink on the surface of the wrapping material to record the time data thereon.

According to the invention, high quality recording can be realized since the time data is recorded by the ink-jet recording means for jetting the ink on the surface of the wrapping material.

In the invention, it is preferable that the ink used in the ink-jet recording means is an edible ink.

According to the invention, the edible ink is used to record the time data; therefore, safety is further improved, particularly in the case where the article to be wrapped is food.

In the invention, it is preferable that the ink-jet recording means records the time data on the surface of the wrapping material, using at least two color inks for a background color and a character color.

According to the invention, at least two color inks for the background color and the character color are used to record the time data; therefore, the time data can be more easily recognized by arranging a background recorded in the background color around the time data recorded in the character color, particularly in the case where the wrapping material is a transparent wrapping material such as a wrap film.

In the invention, it is preferable that a white ink is used in the ink-jet recording means.

According to the invention, particularly in the case where the article to be wrapped is a food, the time data recorded in white color are more easily recognized since kinds of white foods are a few.

In the invention, it is preferable that an ink having a color small in endotherm quantity is used in the ink-jet recording means.

According to the invention, by using the ink having the color small in endotherm quantity, local heat is not generated even if the food combined with the wrapping material is taken out from a refrigerator and the food is heated as it is in an electronic oven. Thus, it is possible to prevent holes from being made in the wrapping material by heat.

In the invention, it is preferable that an ink that is high in affinity with the wrapping material is used in the ink-jet recording means.

According to the invention, the ink that is high in affinity with the wrapping material is used; therefore, it is possible to prevent the time data recorded on the wrapping material from being rubbed or patchy and record the time data stably.

In the invention, it is preferable that the wrapping material is wound around the tubular core and an ink tank for storing the ink used in the ink-jet recording means is stored inside the core for winding the wrapping.

According to the invention, the ink tank for storing the ink is stored inside the core for winding the wrapping; therefore, a space can be saved by the volume of the ink tank and the whole of the apparatus can be made small.

In the invention, it is preferable that the output means is heat-generating recording means for applying heat onto the surface of the wrapping material to record the time data.

According to the invention, the output means is the heat-generating recording means for applying heat onto the surface of the wrapping material to record the time data; therefore, when the time data is recorded, it is unnecessary to use any ink or any ink ribbon. Thus, costs can be lowered. In the case where the article to be wrapped is a food, no bad effect is produced on the food by any ink so that the safety of the food is not damaged.

The invention further comprises wrapping material discharging means for discharging the wrapping material having a necessary length from the wrapping material storing means.

According to the invention, the user can save labor for discharging the wrapping material manually since the invention further comprises the wrapping material discharging means for discharging the wrapping material having a predetermined length.

In the invention, it is preferable that the output means records the time data on the surface of the wrapping material when the length of the wrapping material discharged from the wrapping material storing means is made into a predetermined length.

According to the invention, the output means records the time data on the surface of the wrapping material when the length of the wrapping material discharged from the wrapping material storing means is made into the predetermined length. That is, even if the discharging speed of the wrapping material is not constant as in the case where the wrapping material is manually discharged, the time data can be recorded in a predetermined position of the wrapping material. Therefore, the recording quality of the time data can be improved.

In the invention, it is preferable that the output means records time data on only one surface of the wrapping material and the other surface of the wrapping material is a surface that directly contacts the article to be wrapped with the wrapping material.

According to the invention, the time data is recorded on the surface that does not contact the article in the wrapping material directly; therefore, even if the recording method is any method, no bad effect is produced on the wrapped article. Particularly in the case where the article to be wrapped is a food, even if the output means is means for carrying out recording with an ink, this ink does not produce any bad effect on the food. Thus, the safety of the food is not damaged. This embodiment is preferred for food hygiene.

In the invention, it is preferable that the wrapping material is a wrap film made of a resin for wrapping a food.

According to the invention, the wrapping material is the food-wrapping wrap film made of a resin, and the output means records the time data on this wrap film. Therefore, the user can certainly check the date and time when the food was wrapped. As a result, it can be prevented that the user forgets the date and time of wrapping the food so that the appreciation period of the food that is being preserved has passed or the food has gone bad. Thus, it is possible to prevent the food from being uneatable.

In the invention, it is preferable that the output means records the time data on the surface of the wrapping material and at a position where the time data is highly visible when the article is wrapped with the wrapping material.

According to the invention, the time data is recorded on the wrapping material at the position where the time data is highly visible; therefore, the user can check the time data without pulling out or overturning the article when the user wraps and preserves the article.

In the invention, it is preferable that the output means records the time data on the surface of the wrapping material in the manner that the time data is in parallel to a discharging direction along which the wrapping material is discharged from the wrapping material storing means.

According to the invention, the time data is recorded in the manner that the time data is in parallel to the discharging direction along which the wrapping material is discharged from the wrapping material storing means; therefore, the output means can be made small so that a space can be saved and costs can be lowered.

In the invention, it is preferable that the output means records the same time data plural times on the surface of the wrapping material at predetermined intervals in the discharging direction along which the wrapping material is discharged from the wrapping material storing means.

According to the invention, the same time data is recorded plural times on the surface of the wrapping material at predetermined intervals in the wrapping material discharging direction; therefore, the article can be wrapped in such a manner that the time data is certainly arranged at a highly visible position regardless of the wrapping manner.

In the invention, it is preferable that the output means records the time data on the surface of the wrapping material at the center in the width direction perpendicular to the wrapping material discharging direction.

According to the invention, the time data is recorded at the center in the width direction of the wrapping material; therefore, the article can be wrapped in such a manner that the time data is certainly arranged at a highly visible position regardless of the wrapping manner.

In the invention, it is preferable that the output means records the time data on the surface of the wrapping material when a predetermined length of the wrapping material is discharged from the wrapping material storing means.

According to the invention, the time data is recorded on the surface of the wrapping material when the predetermined length of the wrapping material is discharged from the wrapping material storing means; therefore, the time data is not recorded at the ends of the wrapping material, which overlaps with each other when the article is wrapped to become less visible.

The invention comprises size selecting means for selecting the size of the wrapping material discharged from the wrapping storing means, wherein the output means records the time data at the center of the surface of the discharged wrapping material, dependently on the size of the wrapping material selected by the size selecting means.

According to the invention, the size selecting means can select the size of the wrapping material and further the time data is recorded at the center of the wrapping material having the selected size; therefore, the user can wrap the article in such a manner that the time data is certainly arranged at a highly visible position. Additionally, waste of the wrapping material can be saved. Costs of consumption articles such-as ink can be reduced since it is unnecessary that the time data is recorded plural times.

The invention comprises display means for displaying the time data that are measured by the clock means.

According to the invention, the display means for displaying the time data is set up; therefore, it is possible to check the date and time when the article was wrapped and check whether the time data is precisely recorded.

In the invention, it is preferable that the time data measured by the clock means are data on a date and data on a moment in the date, the display means displays the date data and the moment data, and the output means records the date data and the moment data on the surface of the wrapping material.

According to the invention, the clock means measures the date data and the moment data to generate time data including the date data and the moment data. The display means displays these data and the output means records the time data on the surface of the wrapping material. Therefore, a user can grasp the time data in more detail.

In the invention, it is preferable that the display means displays the moment data more largely than the date data, and the output means records the date data more largely than the moment data.

According to the invention, the display means displays the moment data more largely than the date data. Accordingly, a user can easily recognize the present time so that the user can use the printer for the wrapping material instead of a clock. The output means records the date data more largely than the moment data. Accordingly, the user can easily recognize the date when the article was wrapped and preserved, which are the most important data for the user.

The invention comprises input means for inputting predetermined data, wherein the output means records the predetermined data inputted by the input means on the surface of the wrapping material.

According to the invention, the printer comprises the input means for inputting predetermined data; therefore, the predetermined data, other than the time data, can be recorded on the wrapping material.

In the invention, it is preferable that the predetermined data is a name of a person who wrapped the article or a name of an owner of the article.

According to the invention, the name of the person who wrapped the article or the name of the owner of the article can be recorded on the wrapping material; therefore, it is possible to check easily who possesses the wrapped article. In other words, even if plural persons use the single printer of the invention, it does not happen that who possesses the wrapped article cannot be understood.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
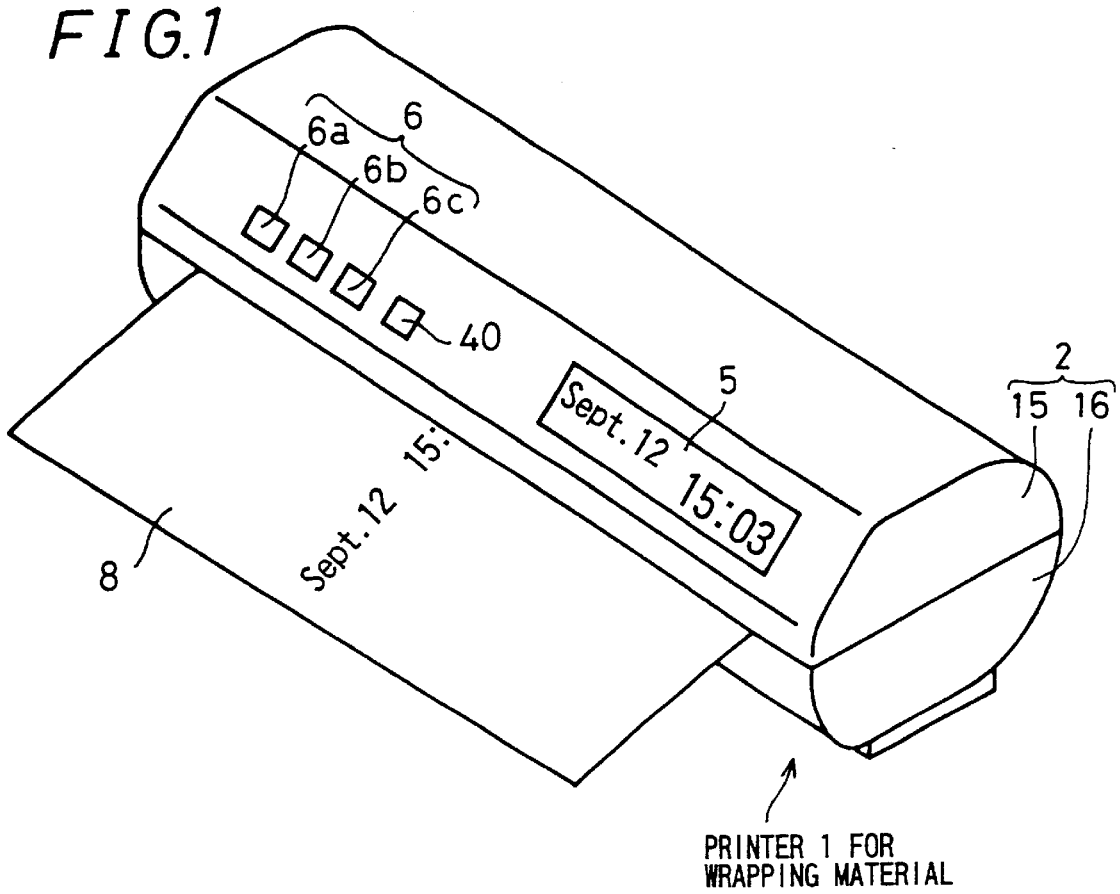
FIG. 1 is a perspective view of a printer 1 for a wrapping material according to an embodiment of the invention.

Now referring to the drawings, preferred embodiments of the invention are described below.

Figure 2:
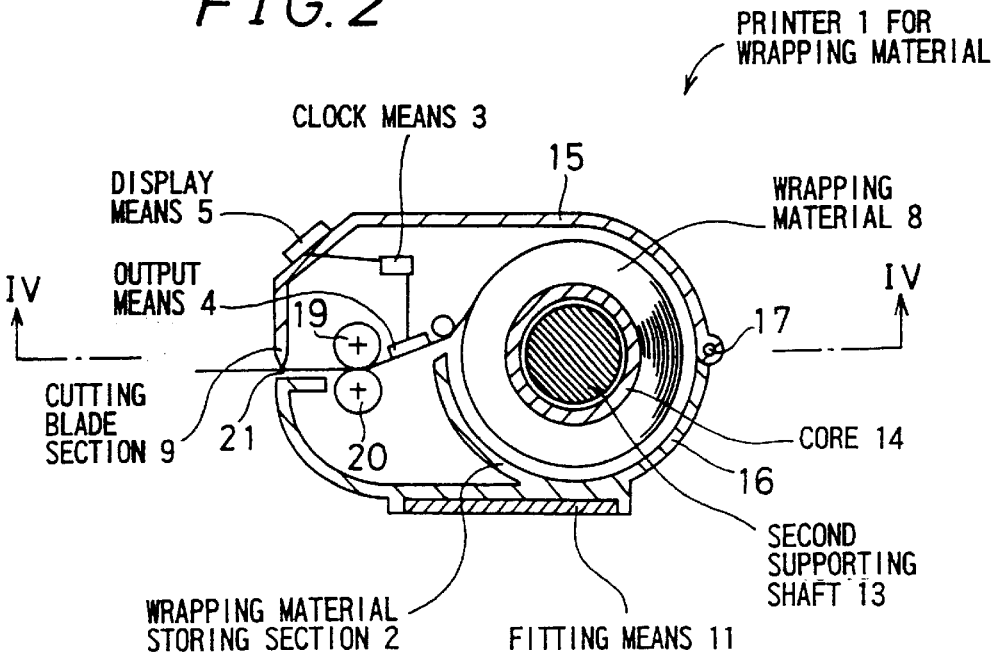
FIG. 2 is a sectional view of the printer 1 for a wrapping material.
Figure 3:
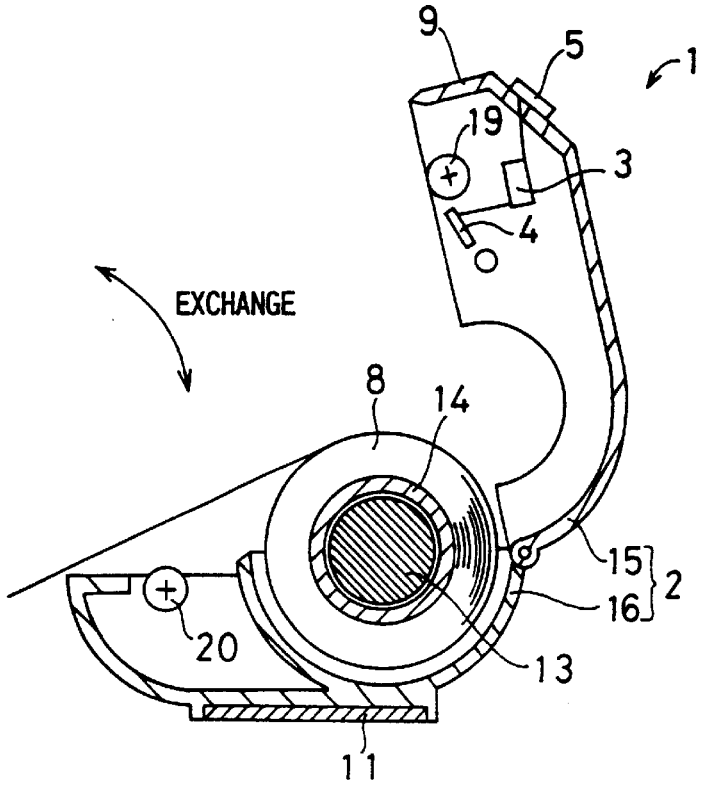
FIG. 3 is a sectional view of the printer 1 for a wrapping material in the state that its lid member 15 is opened.
Figure 4:
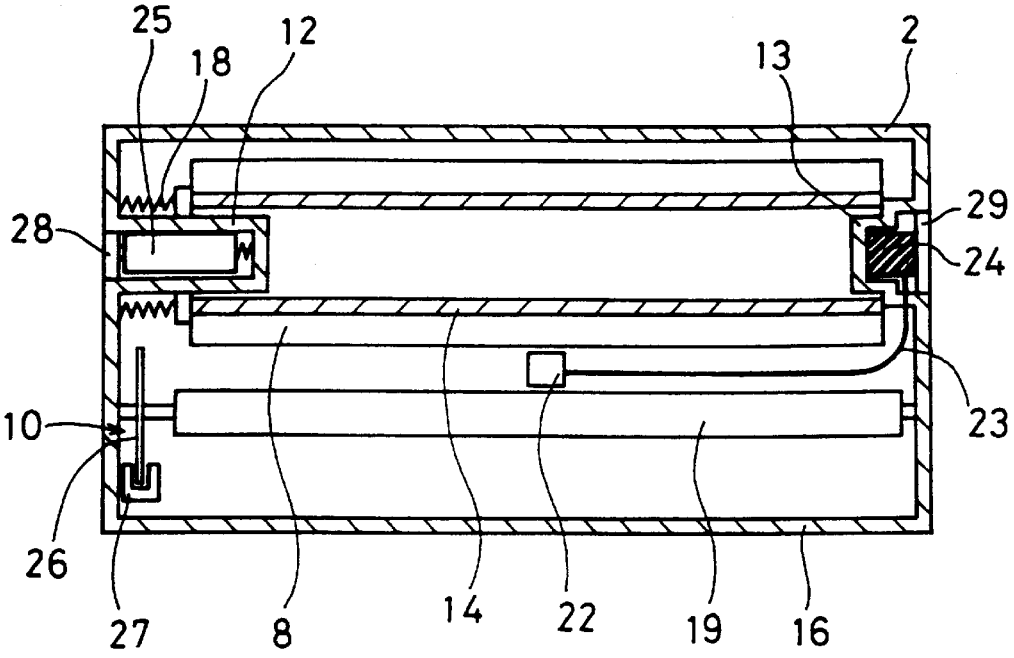
FIG. 4 is a sectional view taken on cutting line IV—IV of FIG. 2.

FIG. 1 is a perspective view of a printer 1 for a wrapping material according to an embodiment of the invention. FIG. 2 is a sectional view of the printer 1 for a wrapping material. FIG. 3 is a sectional view of the printer 1 for a wrapping material in the state that its lid member 15 is opened. FIG. 4 is a sectional view taken on cutting line IV—IV of FIG. 2. The printer 1 for a wrapping material is an apparatus for recording various data on the surface of the wrapping material for wrapping an article, and is more specifically an apparatus for recording time data such as data on a date and data on a moment in the date on the surface of a transparent wrap film 8 for wrapping a food. The printer 1 for a wrapping material is suitably used when a food, stored in a refrigerator, whose preservation period should be preferably checked, is wrapped and then preserved.

The printer 1 for a wrapping material is at least composed of a wrapping material storing section 2 for at least storing the wrap film 8, which is a wrapping material, clock means 3 for measuring time to generate time data, and output means 4 for recording the time data on the surface of the wrapping material.

The wrap film 8 is a film for home or business use, which has been hitherto used for wrapping food, and is usually wound around a tubular core 14 made of paper. Examples of the material of the wrap film 8 include polyvinylidene chloride, polyvinyl chloride, polyethylene, polypropylene, ethylene/vinyl acetate copolymer, and resin compositions obtained by blending one or more of these resins with one or more other resin components and additives. The material of the wrap film 8 is not limited to the above-mentioned materials.

The wrapping material storing section 2 is a long box-shaped member, and is formed by connecting a lid member 15 and a base member 16 to each other at one end in their width direction (the right direction in FIG. 2) with a hinge 17. To both side walls in the longitudinal direction (the right and left direction in FIG. 4) of the wrapping material storing section 2, first and second supporting shafts 12 and 13, which are in parallel to the longitudinal direction and project inside, are fitted. In the case where the wrap film 8 is set up inside the wrapping material storing section 2, the lid member 15 is first opened as shown in FIG. 3 and then the first and second supporting shafts 12 and 13 are inserted into the core 14 as shown in FIG. 4. Thus, the wrap film 8 is axially and rotatably supported. At this time, a spring member 18, which is set up to one side end in the longitudinal direction of the wrapping material storing section 2, urges the core 14 toward the other side end in the longitudinal direction (toward the right side in FIG. 4). Therefore, it is possible to prevent the wrap film 8 from moving inside the wrapping material storing section 2 excessively and prevent the core 14 from falling out from the first and second supporting shafts 12 and 13. Thereafter, the lid member 15 is closed and the pulled-out end of the wrap film 8 is put between a pair of first and second rollers 19 and 20 fitted to the lid member 15 and the base member 16. In this way, the pulled-out wrap film 8 is prevented from being wound, and the setup of the wrap film 8 is finished.

At the other end (left side in FIG. 2) in the width direction of the wrapping material storing section 2, an outlet 21, which is a small gap, for discharging the wrap film 8 is made. At the other end in the width direction of the lid member 15, a cutting blade section 9, which extends in the longitudinal direction (the direction perpendicular to the paper surface on which FIG. 2 is drawn), is made. This cutting blade section 9 cuts the wrap film 8 pulled outside the wrapping material storing section 2 through the outlet 21 from the roll of the wound film by rotation of the core 14 in the counterclockwise direction in FIG. 2 around the first and second supporting shafts 12 and 13.

The wrapping material storing section 2 may be provided with fitting means 11 for fitting up the wrapping material storing section 2 onto a wall, a wall surface of a refrigerator, or the like. The structure of the fitting means 11 is not particularly limited. The structure may be realized by a structure wherein a magnet is set up on the bottom of the base member 16, as shown in FIG. 2, for example, in the case where the wrapping material storing section 22 is fitted up onto a wall surface of a refrigerator.

The inside of the wrapping material storing section 2 may have a detector 10 for detecting the length of the pulled-out wrap film 8 or the pulling-out speed of the wrap film 8. On the basis of the length of the pulled-out wrap film 8 or the pulling-out speed of the wrap film 8, which is detected by the detector 10, the output means 4 records the time data measured by the clock means 3 on the wrap film 8. In other words, even if the output means 4 records the time data on the surface of the wrap film 8 at predetermined recording timing, it is difficult that the time data is recorded so as to be recognized by a user because the pulling-out speed when the user pulls out the wrap film 8 manually is not constant. However, in the case where on the basis of the length of the pulled-out wrap film 8 or the pulling-out speed of the wrap film 8, which is detected by the detector 10, recording timing is decided and then the time data is recorded at this recording timing, recording quality of the time data can be improved.

Figure 5:
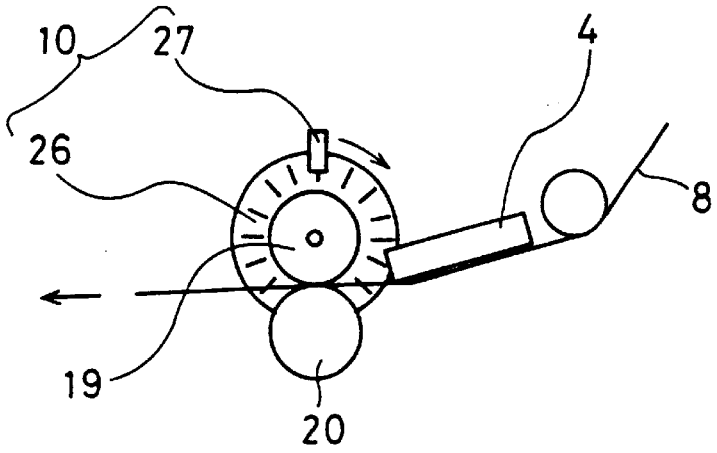
FIG. 5 is a view illustrating a detector 10.

FIG. 5 is a view illustrating the detector 10. The specific structure of the detector 10 is not particularly limited. The structure maybe preferably realized, for example, by a rotary encoder shown in FIG. 5. As shown in FIGS. 4 and 5, an encoder wheel 26 and an optical sensor 27 are set up at one side end in the longitudinal direction of the second roller 19 fitted to the lid member 15. This encoder wheel 26 is arranged concentrically with the second roller 20.

Figure 6:
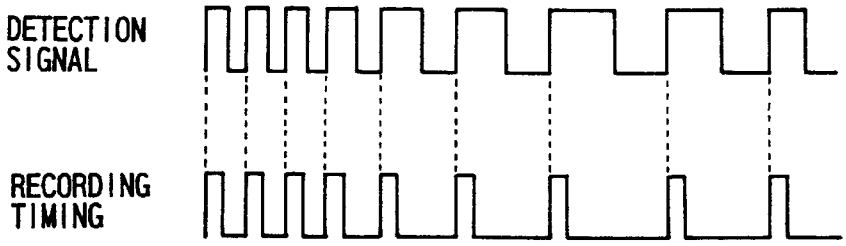
FIG. 6 is a chart illustrating a detection signal that an optical sensor 27 outputs, and recording timing of an output means 4.

FIG. 6 is a chart illustrating a detection signal that the optical sensor 27 outputs, and recording timing of the output means 4. The wrap film 8 is pulled out, so that the second roller 20 and the encoder wheel 26 rotate around their axes in the clockwise direction in FIG. 5. The optical sensor 27 reads the rotation number of the encoder wheel 26 to output a detection signal. In this way, it is possible to grasp the pulling-out speed of the wrap film 8 or the pulled-out length thereof. Therefore, the recording quality of the time data can be improved by synchronizing the recording timing of the output means 4 with the recording signal of the optical sensor 27, as shown in FIG. 6. In other words, a pulse signal is outputted whenever the rotation of the wrap film advances by a predetermined rotation angle, that is, a pulse signal is outputted whenever the warp film is pulled out by a predetermined length; thus, by recording the time data in synchronization with the pulse signals as shown in FIG. 6, the recording can be attained at regular intervals regardless of the pulling-out speed.

The wrapping material storing section 2 may be provided with a wrapping material discharging means for pulling out the wrap film 8 having a predetermined length automatically and discharging it. The structure of this wrapping material discharging means is not particularly limited, and may be realized by a mechanism composed of a motor and a driving roller.

In an inclined plane at the other side (the left side in FIG. 1) in the width direction of the wrapping material storing section 2, size selecting means 6 may be set up. This means 6 is means for selecting the size of the wrap film 8 that the wrapping material discharging means discharges from the wrapping material storing section 2. The size selecting means 6 is composed of, for example, keys 6*a*–6*c*. While a user presses the key 6*a*, the wrapping material discharging means may continue to discharge the wrap film 8. To the other keys 6*b* and 6*c*, lengths that the wrapping material discharging means discharges the wrap film 8 are set beforehand. When the user presses either one of the keys 6*b* and 6*c*, the wrapping material discharging means may discharge the wrap film 8 having a predetermined length corresponding to the pressed key.

As described above, according to the structure wherein the wrapping material discharging means automatically discharges the wrap film 8, recording quality is improved by setting the output means 4 in such a manner that the output means 4 records the time data in synchronization with the wrap film discharging operation of the wrap film 8 by the wrapping material discharging means.

The structure of the output means 4 is not particularly limited so far as the time data can be stably recorded on the surface of the wrap film 8. The structure is realized, for example, by the ink-jet recording means 4*a* for jetting ink the surface of the wrap film 8 and recording the time data.

When the output means 4 is the ink-jet recording means 4*a*, the time data can be recorded on the surface of the wrap film 8 with high quality. As shown in FIG. 4, the ink-jet recording means 4*a* is composed of an ink-jet head 22 for jetting ink on the surface of the wrapping material 8, an ink tank 24 for storing the ink, and an inkpipe 23 for connecting the ink-jet head 22 and the ink tank 24. The ink used in the ink-jet recording means 4*a* is not particularly limited so far as the ink is made of a material that produces no bad effect on the wrap film 8 and does not damage various effects following the wrapping of an article. Preferably, the ink is an edible ink. The edible ink is an ink made of a food material. Thus, if the ink is put into user's mouth by mistake or the ink adheres to user's skin, the ink exhibits no toxicity. Therefore, in the case where the article to be wrapped is food, safety can be further improved. Even if an article other than food is wrapped, it is possible to avoid a risk caused when an infant puts the wrapped food into his/her mouth.

As the edible ink, there can be preferably used any edible ink for ink-jet that has been hitherto used. The edible ink is generally composed of a food color and an eatable solvent. If necessary, the edible ink may comprise an eatable stabilizer; an eatable resin and the like; and eatable additives such as a perfume, an antiseptic, an antifoaming agent, a germicide, and a surfactant.

The above-mentioned food color may be any one of food colors that have been hitherto used. Examples thereof include tar type synthetic food colors, natural coloring matter derivative synthetic food colors, natural synthetic food colors, anthocyanin type natural coloring matters, carotenoid type natural coloring matters, quinone type natural coloring matters, flavonoid type natural coloring matters, betaine type natural coloring matters, monascus type coloring matters, and other natural coloring matter such as turmeric color, kusagi color, gardenia red color and spirulina color.

Examples of the tar type synthetic food color include Food Red No. 2, Food Red No. 3, Food Red No. 40, Food Red No. 102, Food Red No. 104, Food Red No. 105, Food Red No. 106, Food Yellow No.4, Food Yellow No.5, Food Blue No.1, Food Blue No.2, Food Red No.2 aluminum lake, Food Red No.3 aluminum lake, Food Red No.40 aluminum lake, Food Yellow No.4 aluminum lake, FoodYellow No.5 aluminum lake, Food Blue. No.1 aluminum lake and Food Blue No.2 aluminum lake.

Examples of the natural coloring matter derivative synthetic food color include copper chlorophyll, sodium copper chlorophyllin, and potassium norbixin.

Examples of the natural synthetic food color include β-carotene and riboflavin.

Examples of the anthocyanin type natural coloring matter include red radish color, red cabbage color, elderberry color, cowberry color, gooseberry color, cranberry color, salmonberry color, perillia color, thimblueberry color, strawberry color, dark sweet cherry color, cherry color, hibiscus color, huckeleberry color, grape juice color, grape skin color, black currant color, blackberry color, blueberry color, plum color, whortleberry color, boysenberry color, mulberry color, purple sweet potato color, purple corn color, purple yam color, raspberry color, red currant color and loganberry color.

Examples of the carotenoid type natural coloring matter include annatto color and gardenia yellow color.

Examples of the quinone type natural coloring matter include cochineal color, lithospermum root color and lac color.

Examples of the flavonoid type natural coloring matter include safflower yellow color, kaoliang color and onion color.

Examples of the betain type natural coloring matter include beet red color.

Examples of the monascus coloring matter include monascus color and monascus yellow.

Examples of the eatable solvent include water, ethanol, glycerin, and propylene glycol. These may be used alone or in combination of two or more.

Preferably, the ink-jet recording means 4*a* records the time data on the surface of the wrap film 8, using inks in at least two color inks for a background color and a character color. When only an ink in one color is used to record the time data in the case where the wrapping material is a transparent material, for example, the warp film 8, there is a possibility that the recorded time data cannot be easily recognized dependently on the color of the article to be wrapped. However, the time data is easily recognized by recording a background around the time data with an ink in a background color.

In the case of a transparent wrapping material for wrapping food, for example, the wrap film 8, the ink-jet recording means 4*a* preferably records the time data, using a white ink. Since the kinds of white foods are a few, the time data recorded in white can easily be recognized.

The kind of an edible ink for the white ink is not particularly limited. For example, an ink composition disclosed in Japanese Unexamined Patent Publication JP-A 8-113746 (1996) is preferred. In this ink composition, titanium dioxide pigment having a grain size of 0.1 to 3.0 $\mu$m is contained in an amount of 4.0 to 16.0% of an aqueous carrier, a binder is contained in an amount of 2.0 to 10.0% of the aqueous carrier, and the ratio of the pigment to the binder is 0.4 to 8.0.

The ink-jet recording means 4*a* preferably records the time data, using an ink small in endotherm quantity, the example of which is a white ink. In the case where the wrapping material is the wrap film 8, the following use situation is frequently caused: the wrapped food is preserved in a refrigerator, is then taken out from the refrigerator, and is heated as it is in an electronic oven. If in this case the color of the ink with which the data is recorded has a small endotherm quantity, local heating is not caused to make it possible to prevent such inconveniences as making a hole in the wrap film 8 by the heat. The ink small in endotherm quantity is not particularly limited, and may be any one of inks except black inks.

The ink used in the ink-jet recording means 4*a* preferably has high affinity with the material used as the wrapping material, that is, the wrap film 8. When the ink and the wrapping material have low affinity with each other, the recorded data is rubbed or patchy to cause problems that the data become difficult to see or the recorded data become unstable. However, in the case where the ink having high affinity with the wrapping material, stable recording of the data can be attained and a user can check the time data easily. In the case where the wrapping material is, for example, the wrap film 8, it is preferred to use a lipophilic oil having high affinity with the material of the resin used in the wrap film 8. For example, when an aqueous ink is used on the wrap film 8, much time is required for drying the ink. If the ink contacts water, the dried and fixed ink dissolves. Therefore, the aqueous ink cannot be positively used as the ink for the wrap film 8 for wrapping food or the like. Moreover, the ink used in the ink-jet recording means 4*a* is preferably an ink that is solid at ambient temperature and is heated and melted to be jetted when the ink is used rather than an ink that is liquid at ambient temperature.

Figure 7:
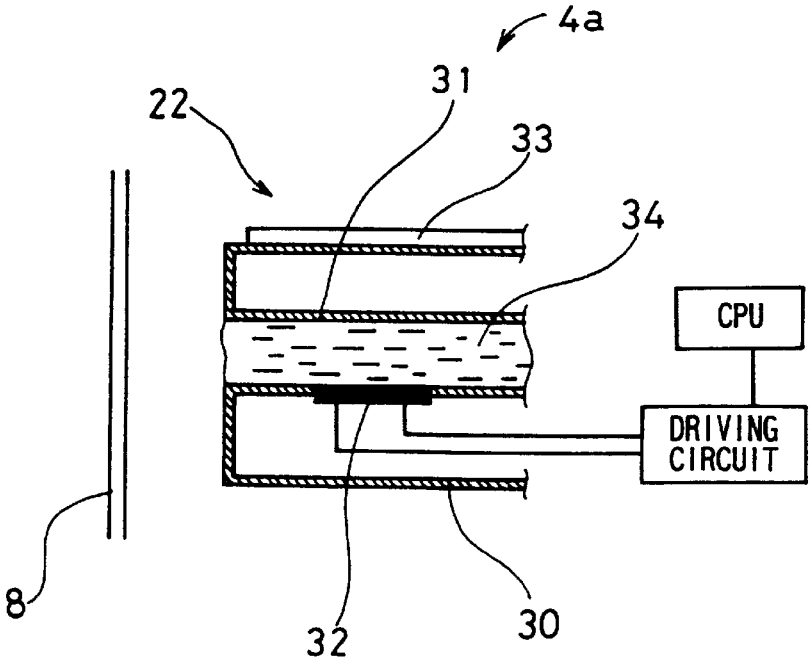
FIG. 7 is a view illustrating ink-jet recording means 4*a* as an output means.
Figure 8:
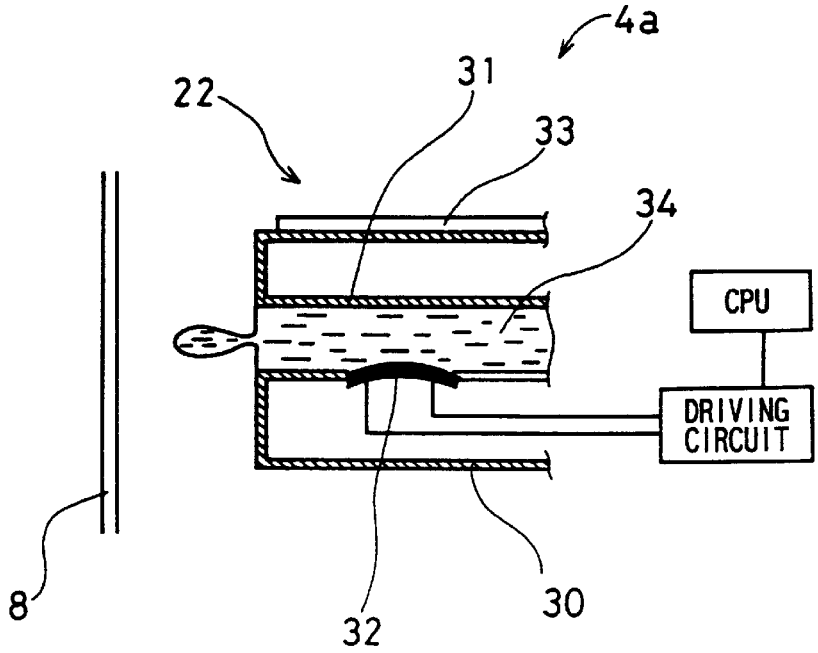
FIG. 8 is a view illustrating the ink-jet recording means 4*a* in the state of jetting out ink.

FIG. 7 is a view illustrating an ink-jet head 22. FIG. 8 is a view illustrating the ink-jet head 22 in the state of jetting out an ink onto the wrap film 8. As shown in FIG. 7, this ink-jet head 22 is composed of a head case 30, a nozzle 31 arranged inside this head case 30, a piezoelectric element 32 fitted into an opening made in a wall of the nozzle 31, and a heater 33 set on the upper surface of the head case 30. A heated and melted ink 34 is supplied and filled from an ink tank 24 into the nozzle 31. The heater 33 heats the ink inside the nozzle 31 so that this ink 34 is not solidified inside the nozzle 31.

The piezoelectric element 32 is controlled through a driving circuit by a CPU, so that an electric current to the piezoelectric element 32 is sent or broken. In the case where an electric current is sent to the piezoelectric element 32 to apply a predetermined voltage thereto, the piezoelectric element 32 deforms as shown in FIG. 8. In this way, pressure is applied to the ink 34 inside the nozzle 31 so that the ink is jetted in the form of small particles from the tip of the nozzle 31 to the wrap film 8. The jetted ink is adhered onto the wrap film 8 so that a 1-dot printing is carried out. By adjusting the voltage applied to the piezoelectric element 32, the ink-jet head 22 can adjust (i.e., increase or decrease) the amount of the ink per dot jetted from the nozzle 31. Namely, as the applied voltage is made larger, the deformation amount of the piezoelectric element 32 becomes larger and the amount of the jetted ink also becomes larger.

Electric power for the clock means 3, the output means 4 and the detector 10 may be supplied from a socket (electric power for AC). Preferably, the electric power is supplied from a battery 25 stored inside the wrapping material storing section 2. This makes it possible to improve the flexibility of the position where the printer 1 for a wrapping material is set up and carry the printer 1 for a wrapping material. As shown in FIG. 4, the battery 25 is put inside the first supporting shaft 12 for supporting the core 14 for winding the wrap film 8. Since a cover 28 at one side in the longitudinal direction of the first supporting shaft 12 is set to be freely put on and taken off, the cover 28 is taken off so that only the battery 25 can be exchanged without opening the lid member 15 of the printer 1 for a wrapping material. The efficiency of the battery-exchanging work is high.

As shown in FIG. 4, the ink tank 24 of the ink-jet recording means 4*a* is stored inside the second supporting shaft 13 for supporting the core 14 for winding the wrap film 8. A cover 29, which is at the other end side in the longitudinal direction of the second supporting shaft 13, is set up to be freely put on and taken off. Therefore, when there is no more ink inside the ink tank 24, the cover 29 is taken off without opening the lid member 15 of the printer 1 for a wrapping material so that only the ink tank 24 can be exchanged. Thus, work efficiency is high.

Thus, since the battery 25 and the ink tank 24 are stored in the first and second supporting shafts 12 and 13, a space of the printer 1 for a wrapping material can be saved by the volume of the battery 25 and the ink tank 24. Therefore, the whole of the apparatus can be made small-sized. In this way, the flexibility of the position where the printer 1 for a wrapping material is set can be improved.

The output means 4 of the printer 1 for a wrapping material according to the invention can record the time data at a position which is highly visible when an article is wrapped. More specifically, the printer 1 according to the invention can attain at least first-fourth recording manners described below.

Figure 9:
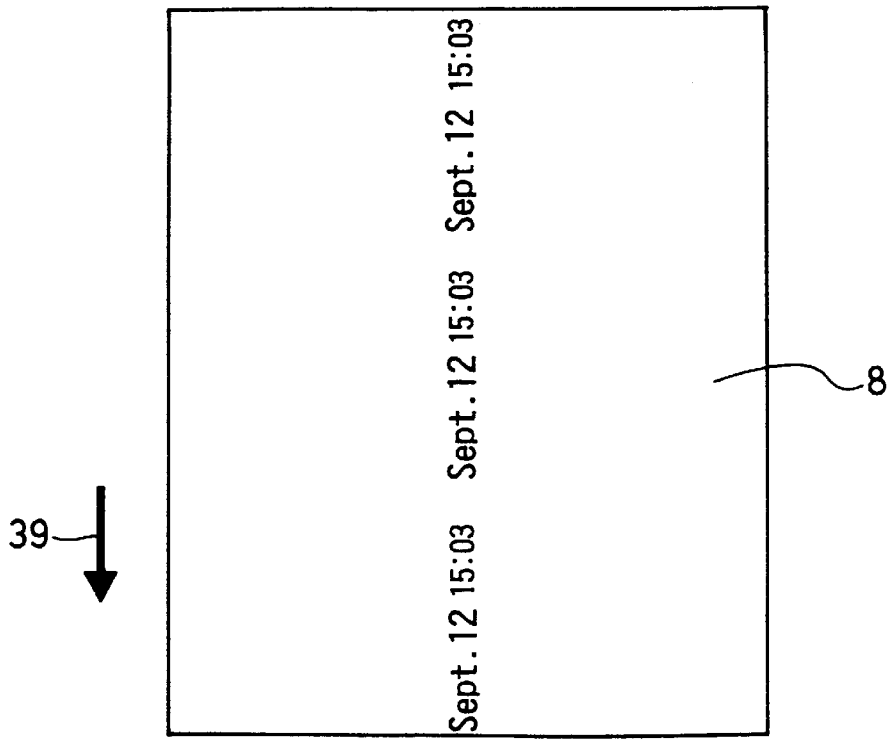
FIG. 9 is a view illustrating a wrap film 8 on which time data is recorded by combining first-fourth recording manners.
Figure 10:
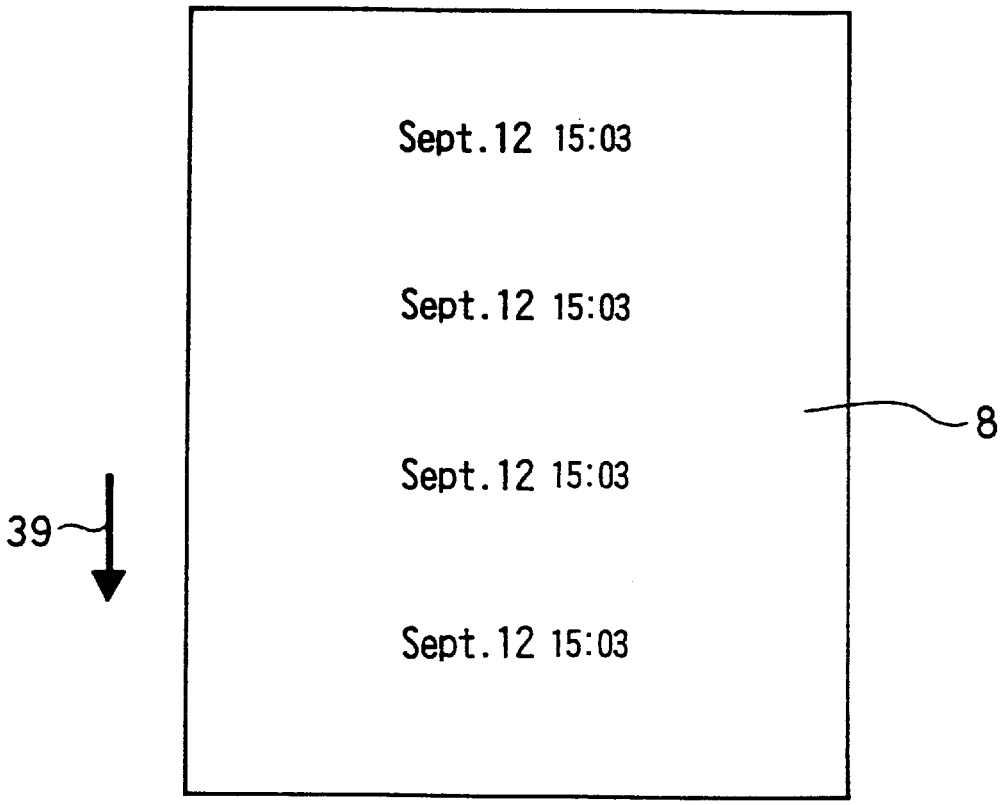
FIG. 10 is a view illustrating the wrap film 8 on which time data is recorded by combining second-fourth recording manners.

FIG. 9 is a view illustrating the wrap film 8 on which time data is recorded by combining the first-fourth recording manners. FIG. 10 is a view illustrating the wrap film 8 on which time data is recorded by combining the second-fourth recording manners.

As shown in FIG. 9, the first recording manner is a manner of recording the time data on the surface of the wrapping material in the manner that the data is in parallel to a discharging direction 39 along which the wrap film 8 is discharged from the wrapping material storing section 2. According to the first recording manner, the time data is recorded one character by one character, following the discharging of the wrap film 8. It is therefore possible to make the size of the output means 4, that is, the ink-jet head 22 of the ink-jet recording means small, and make the movable scope of this head 22 small. For this reason, the whole of the output means 4 can be made small.

As shown in FIGS. 9 and 10, the second recording manner is a manner of recording the same time data plural times on the surface of the wrapping at predetermined intervals in the discharging direction 39 along which the wrapping material is discharged. According to the second manner, the same time data is periodically recorded plural times regardless of the size of the wrapping manner 8. Thus, when an article is wrapped, the area where the time data is recorded can be certainly set at a highly visible position for a user. This second recording manner is particularly effective for the case that the used-area of the wrap film 8 is large.

As shown in FIGS. 9 and 10, the third recording manner is a manner of recording the time data at the center in the width direction of the wrapping material. According to the third recording manner, the time data is recorded at the center in the width direction of the wrap film 8; therefore, the area where the time data is recorded can be certainly set at a highly visible position for a user when an article is wrapped. This third recording manner is particularly effective for the case that the used-area of the wrap film 8 is small.

As shown in FIGS. 9 and 10, the fourth recording manner is a manner of recording the time data when a predetermined length of the wrapping material is discharged from the wrapping material storing section 2. Namely, the time data is recorded after a predetermined time passes from the pulling-out of the wrap film 8. In the case where the wrap film 8 is pulled out, the region initially pulled out becomes an end region for wrapping. Therefore, in the case where the time data is recorded on this end region, this data is less visible for a user. However, the fourth recording manner makes it possible to cancel such inconveniences that the time data is recorded on the pulled-out end of the wrap film 8, which is less visible for the user when an article is wrapped. Thus, useless recording is not carried out and costs of consumption articles such as ink are reduced. The first-fourth recording manners are suitable for the case that the user pulls out the wrap film 8 manually.

Figure 11:
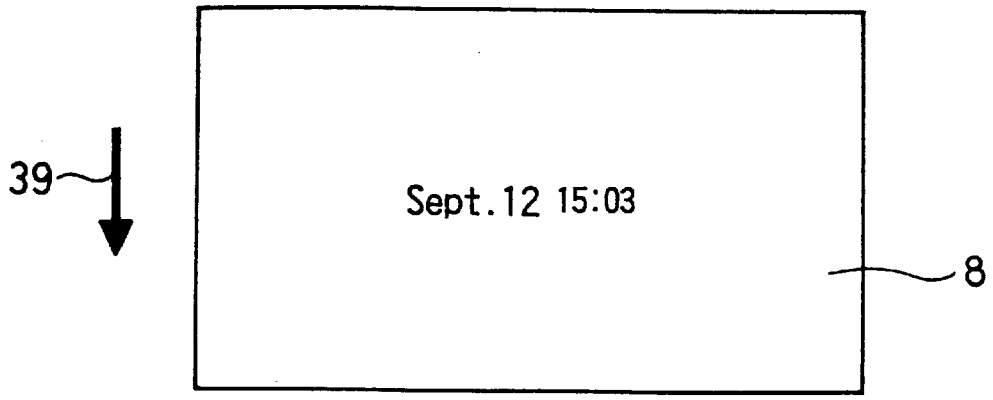
FIG. 11 is a view illustrating the wrap film 8 whose used-area is small in a fifth recording manner.
Figure 12:
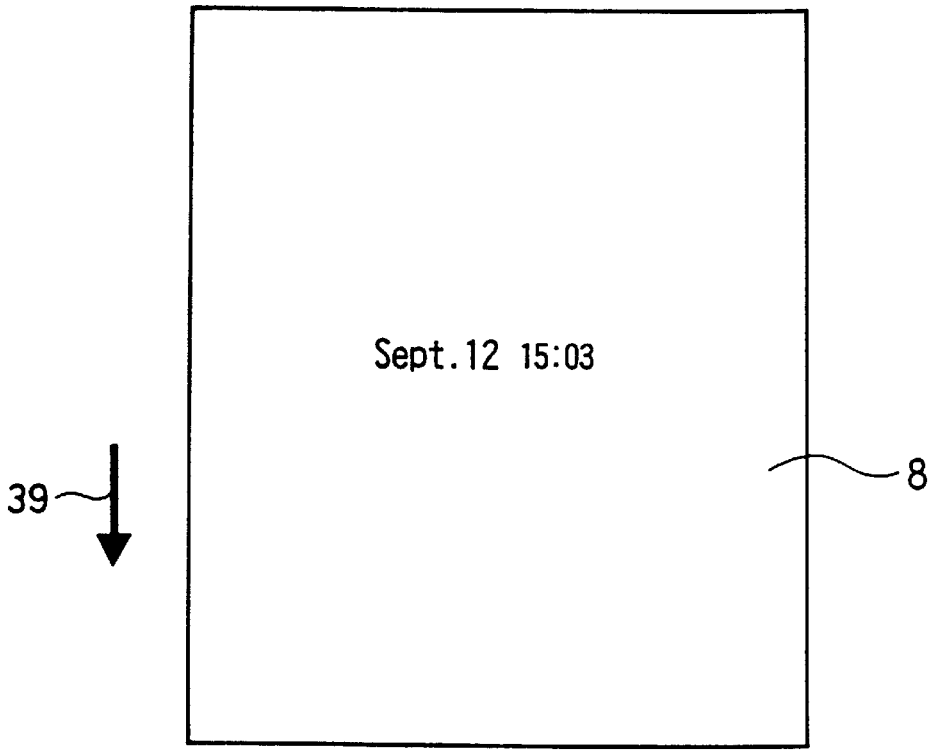
FIG. 12 is a view illustrating the wrap film 8 whose used-area is large in the fifth recording manner.

The printer 1 for a wrapping material according to the invention can attain a fifth recording manner. FIG. 11 is a view illustrating the wrap film 8 whose used-area is small, on which the time data is recorded in the fifth recording manner. FIG. 12 is a view illustrating the wrap film 8 whose used-area is large, on which the time data is recorded in the fifth recording manner. The fifth recording manner is a manner of recording the time data at the center of the surface of the discharged wrapping material, dependently on the size of the wrapping material selected by size selecting means 6.

According to the fifth recording manner, the time data is recorded at the center of the wrap film 8, dependently on the size of the wrap film 8 selected by the size selecting means 6. Therefore, the area where the time data is recorded can be certainly set at a highly visible position for a user when an article is wrapped. Moreover, costs of consumption articles can be reduced since it is unnecessary that the time data is recorded plural times. The fifth recording manner is suitable for the case that the wrapping material discharging means automatically pulls out the wrap film 8.

The first-fourth recording manners can be applied to not only the case that a user pulls out the wrap film 8 manually but also the case that the wrap film 8 is automatically pulled out by the wrapping material discharging means. The fifth recording manner can be applied to not only the case that the wrap film 8 is automatically pulled out by the wrapping material discharging means but also the case that a user pulls out the wrap film manually.

In the case where the wrapping material is the wrap film 8 as in the present embodiment, many of articles wrapped with the wrap film 8 are foods. Therefore, when a food is wrapped with the wrap film 8, the output means 4 preferably records the time data on one surface thereof which does not contact the food directly. Namely, the wrap film 8 is pulled out on a food and is then pulled down as it is; thus, the lid member 15 side of the film 8, that is, the upper surface side thereof becomes the surface which does not contact the food, and the time data is recorded on this surface. Since the time data is recorded on the surface which does not contact the food directly in this way, regardless of the recording manner of the output means 4, it can be avoided that various effects are produced on the wrapped food. In the case where the output means 4 is the ink-jet recording means 4*a* as in the present embodiment, the ink has no bad effect on the food. Therefore, the safety of the food is not damaged to have a good effect on food hygiene.

As shown in FIGS. 1 and 2, the printer 1 for a wrapping material of the embodiment may be provided with display means 5 for displaying the time data measured by the clock means 3. This display means 5 is fitted onto the inclined plane at the other side (the left side in FIG. 2) in the width direction of the wrapping material storing section 2. The specific structure of the display means is not particularly limited, and is preferably realized by a liquid crystal display unit. The liquid crystal display unit makes small and high-quality display possible and causes power consumption to be reduced. Since the display means 5 displays the same time data as the output means 4 records on the wrapping material, for example, the wrap film 8, a user can check the date and time when the article was wrapped. It can also be checked whether the time data that the display means 5 displays are consistent with the time data that the output means 4 records.

The time data displayed by the display means 5 and recorded by the output means 4 include data on a date and data on a moment in the date. In short, the clock means 3 measures, as the time data, at least data on a date and data on a moment in the date. Therefore, a user can grasp the time data more minutely.

As shown in FIG. 1, the display means 5 preferably displays the moment data more largely than the date data. Since the printer 1 for a wrapping material can be set on the wall surface of a refrigerator, a wall or the like at any time except the time when an article is wrapped, the printer 1 for a wrapping material can be used in the way similar to ordinary clocks in the case where the display means 5 displays the time data including the date data and the moment data. This moment data is largely displayed since the moment data is frequently checked by the display means 5, which is routinely watched. As a result, a user can easily be checked the moment data.

As shown in FIG. 1, the output means 4 preferably records the date data more largely than the moment data. That is, in the case where the wrapping material is the wrap film 8, the time data is recorded when a food is preserved. Therefore, the date data when the article was preserved becomes more important data than the moment data when the article was preserved. Thus, the date data is largely recorded.

As shown in FIG. 1, the printer 1 for a wrapping material of the invention may further comprise input means 40 for inputting predetermined data. In this case, the output means 4 can record the predetermined data inputted by the input means 40. Therefore, the predetermined data, other than the time data, can be recorded on the surface of the wrap film 8.

The data inputted by the input means 40 are preferably a name of a person who wrapped the article or a name of an owner of the article. In this case, the output means 4 records the name of the person who wrapped the article or the name of the owner of the article on the surface of the wrap film 8; therefore, it is possible to check easily who possesses the wrapped and preserved or stored article. For this reason, even if plural persons use the single printer 1 for a wrapping material, it is possible to prevent such inconveniences that who possesses the wrapped article cannot be understood.

The input means 40 may have a structure wherein various data can be inputted. However, the input means 40 preferably has a structure wherein only simple data specified beforehand can be inputted. In this case, it is possible to save labor that a user inputs complicated data.

As the manner of inputting the name of the person who wrapped the article or the name of the owner of the article, for example, the following manner can be mentioned: non-illustrated buttons corresponding to respective owners of articles are set up in the wrapping material storing section 2 and the names of the owners of the articles are registered through the corresponding buttons. According to this manner, when any one of the owners of the articles pushes the corresponding button, his/her name data is inputted so that the outputs means 4 records the name data on the surface of the wrap film 8.

As another input manner, the following manner can be mentioned: a non-illustrated button is set up in the wrapping material storing section 2 and the present printer for a wrapping material is made beforehand in the manner that desired owner's name can be selected dependently on the number of times that this button is pushed. For example, in the case where the button is pushed one time, two times and three times, names of a mother, a father and their child are displayed, respectively, on the display means 5. While referring to the name data displayed on the display means 5, the owner of an article selects and inputs owner's name from the displayed names. Thereafter, the output means 4 records the inputted name on the surface of the wrap film 8.

As described above, data (such as names, figures or symbols) for distinguishing the owner of an article, together with the time data including the date data and the moment data, are recorded on the surface of the wrap film 8. Therefore, the printer 1 for a wrapping material having the input means 40 of the invention is suitably used in the case where plural persons use a single refrigerator, for example, a refrigerator at home.

Figure 13:
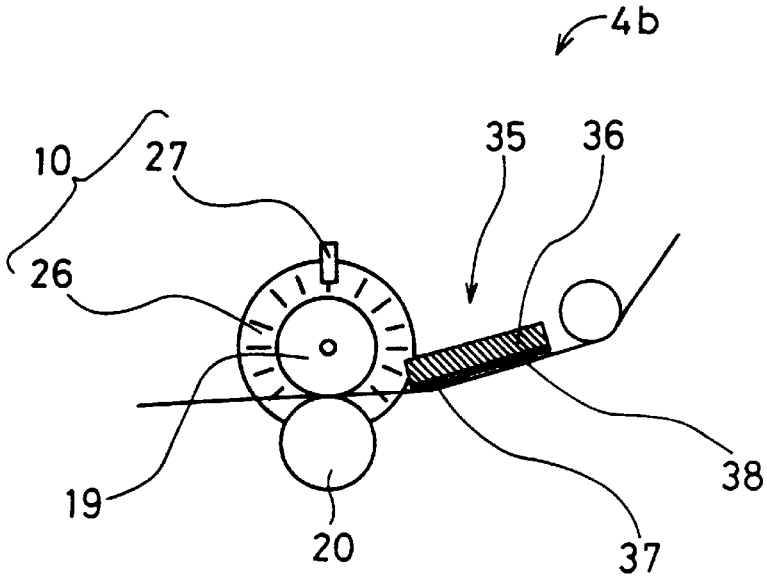
FIG. 13 is a view illustrating heat-generating recording means 4*b*.

FIG. 13 is a view illustrating heat-generating recording means 4*b*, which is output means in the printer for a wrapping material of another embodiment according to the invention. In FIG. 13, the same reference numbers are attached to members having the same effect and advantages as in the above-mentioned embodiment. Explanation thereof is omitted. The heat-generating recording means 4*b* is realized, for example, by a thermal head 35.

In the thermal head 35, a thick layer heat-generating resistor 37 as a heat generator in the form of a band 1 mm in width and 20 $\mu$m in thickness is formed on, for example, a surface of a ceramic substrate 36 having a thickness of 1 mm, and further electrodes are made at both ends thereof. To make the surface property thereof good and improve the abrasion resistance thereof, a protective layer 38 made of a glass ceramic is made. Electric power is supplied to the thick layer heat-generating resistor 37 through the electrodes, so that the thick layer heat-generating resistor 37 is heated at a predetermined position. As a result, thermal energy is given to the wrap film 8 moving while contacting the thermal head 35, so that the time data is recorded on the surface of the wrap film 8. In the present embodiment, the thick layer heat-generating resistor 37 is used as a heat-generator. Even if a thin layer heat-generating resistor is used, the time data can be recorded in the same way. The present inventor used the thermal head 35 to output characters on the surface of the wrap film 8. As a result, the inventor verified that clouded characters were produced on the transparent wrap film 8.

As described above, in the case where the heat-generating recording means 4*b* is used as the output means, the wrapping material, for example, the wrap film 8 is deformed or modified by heat from the thermal head 35, so that the time data is recorded. Therefore, it is unnecessary to use consumption articles such as ink or an ink ribbon. Thus, costs can be reduced. When ink or an ink ribbon is used to record the time data in the case where an article to be wrapped is a food, it is necessary to consider safety thereof. However, in the case where the time data is recorded by the heat-generating recording means 4*b* as in the present embodiment, consideration of the safety is unnecessary since the wrap film 8 itself is merely deformed or modified.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A printer for a wrapping material comprising:

wrapping material storing means for storing the wrapping material for wrapping an article, the wrapping material having two surfaces, one of the surfaces for directly contacting the article to be wrapped by the wrapping material, clock means for measuring time to generate time data, and output means for recording the time data on a surface of the wrapping material, the output means located only on one side surface of the wrapping material which is opposite to the contacting surface, wherein when the wrapping material is discharged from the wrapping material storing means, the output means records the time data on only one side surface of the wrapping material which is a surface opposite to the surface for contacting the article.

2. The printer for a wrapping material of claim 1, wherein the wrapping material is wound around a tubular core, and the wrapping material storing means is provided with a supporting shaft for supporting the wrapping material wound around the core axially and rotatably, and a cutting blade section for cutting the wrapping material discharged from the wrapping material storing means by rotation of the core.

3. The printer for a wrapping material of claim 2, wherein a power source section is stored in the core for winding the wrapping material.

4. The printer for a wrapping material of claim 1, wherein the output means is ink-jet recording means for jetting an ink on the surface of the wrapping material to record the time data thereon.

5. The printer for a wrapping material of claim 4, wherein the ink used in the ink-jet recording means is an edible ink.

6. The printer for a wrapping material of claim 4, wherein the ink-jet recording means records the time data on the surface of the wrapping material, using at least two color inks for a background color and a character color.

7. The printer for a wrapping material of claim 4, wherein a white ink is used in the ink-jet recording means.

8. The printer for a wrapping material of claim 4, wherein an ink having a color small in endotherm quantity is used in the ink-jet recording means.

9. The printer for a wrapping material of claim 4, wherein an ink that is high in affinity with the wrapping material is used in the ink-jet recording means.

10. The printer for a wrapping material of claim 4, wherein the wrapping material is wound around the tubular core and an ink tank for storing the ink used in the ink-jet recording means is stored inside the core for winding the wrapping.

11. The printer for a wrapping material of claim 1, wherein the output means is heat-generating recording means for applying heat onto the surface of the wrapping material to record the time data.

12. The printer for a wrapping material of claim 1, further comprising:

wrapping material discharging means for discharging the wrapping material having a necessary length from the wrapping material storing means.

13. The printer for a wrapping material of claim 1, wherein the output means records the time data on the surface of the wrapping material when the length of the wrapping material discharged from the wrapping material storing means is made into a predetermined length.

14. The printer for a wrapping material of claim 1, wherein the wrapping material is a wrap film made of a resin for wrapping a food.

15. The printer for a wrapping material of claim 1, wherein the output means records the time data on the surface of the wrapping material and at a position where the time data is highly visible when the article is wrapped with the wrapping material.

16. The printer for a wrapping material of claim 1, wherein the output means records the time data on the surface of the wrapping material in the manner that the time data is in parallel to a discharging direction along which the wrapping material is discharged from the wrapping material storing means.

17. The printer for a wrapping material of claim 1, wherein the output means records the same time data plural times on the surface of the wrapping material at predetermined intervals in the discharging direction along which the wrapping material is discharged from the wrapping material storing means.

18. The printer for a wrapping material of claim 1, wherein the output means records the time data on the surface of the wrapping material at the center in the width direction perpendicular to the wrapping material discharging direction.

19. The printer for a wrapping material of claim 1, wherein the output means records the time data on the surface of the wrapping material when a predetermined length of the wrapping material is discharged from the wrapping material storing means.

20. The printer for a wrapping material of claim 1, further comprising:

size selecting means for selecting the size of the wrapping material discharged from the wrapping storing means, wherein the output means records the time data at the center of the surface of the discharged wrapping material, dependently on the size of the wrapping material selected by the size selecting means.

21. The printer for a wrapping material of claim 1, further comprising:

display means for displaying the time data that are measured by the clock means.

22. The printer for a wrapping material of claim 21, further comprising:

the time data measured by the clock means are data on a date and data on a moment in the date, the display means displays the date data and the moment data, and the output means records the date data and the moment data on the surface of the wrapping material.

23. The printer for a wrapping material of claim 22, wherein the display means displays the moment data more largely than the date data, and the output means records the date data more largely than the moment data.

24. The printer for a wrapping material of claim 1, further comprising:

input means for inputting predetermined data, wherein the output means records the predetermined data inputted by the input means on the surface of the wrapping material.

25. The printer for a wrapping material of claim 24, wherein the predetermined data includes letters.

26. The printer for a wrapping material of claim 1, wherein the recording is solely edible ink.

27. The printer for a wrapping material of claim 1, wherein the wrapping material is transparent.

28. A printer for a wrapping material comprising:

wrapping material storing means for storing the wrapping material for wrapping an article, the wrapping material having two surfaces, one of the surfaces for directly contacting the article to be wrapped by the wrapping material, clock means for measuring time to generate time data, and output means located solely on one side surface of the wrapping material for recording the time data on a surface of the wrapping material, which is opposite to the surfaces for directly contacting the article to be wrapped by the wrapping material, wherein when the wrapping material is discharged from the wrapping material storing means, the output means records the time data directly on the surface of the wrapping material which is a surface opposite to the surface that directly contacts the article to be wrapped, with edible ink, which does not adversely affect the wrapping material.

29. The printer for a wrapping material of claim 27, wherein the ink is non-toxic.

30. The printer for a wrapping material of claim 28, wherein the wrapping material is transparent.

31. A printer for a wrapping material comprising:

wrapping material storing means for storing the wrapping material, the wrapping material having two surfaces, one surface contacts the article to be wrapped, clock means for measuring time to generate time data, and output means for recording the time data, the output means exists solely on one side surface of the wrapping material which is opposite to a surface of the wrapping material that contacts the article to be wrapped, wherein when the wrapping material is discharged from the wrapping material storing means, the output means records the time data on the solely on one side surface of the wrapping material, the wrapping material being effective to completely wrap the article.

* * * * *